US006026873A

United States Patent [19]

Van Geer

[11] Patent Number: 6,026,873

[45] Date of Patent: Feb. 22, 2000

[54] HOLDER FOR CREDIT CARDS

[76] Inventor: René Johan Van Geer, Haagweg 163, NL-2281 AJ, Rijskwijk, Netherlands

[21] Appl. No.: 09/011,337

[22] PCT Filed: Aug. 8, 1996

[86] PCT No.: PCT/NL96/00318

§ 371 Date: Feb. 11, 1998

§ 102(e) Date: Feb. 11, 1998

[87] PCT Pub. No.: WO97/06709

PCT Pub. Date: Feb. 27, 1997

[30] Foreign Application Priority Data

Aug. 11, 1995 [NL] Netherlands ..... 1000970

[51] Int. Cl.[7] ..... A45C 11/18

[52] U.S. Cl. ..... 150/147; 206/37; 206/39.5

[58] Field of Search ..... D3/215, 247; 150/147; 206/37, 39, 39.5

[56] References Cited

U.S. PATENT DOCUMENTS

| | | | |
|---|---|---|---|
| 415,457 | 11/1889 | Hart | 206/39.5 |
| 501,279 | 7/1893 | Knight | 206/39 |
| 646,726 | 4/1900 | Cheiimer | 206/37 |
| 1,989,159 | 1/1935 | Shiffman et al. | 206/37 R X |
| 2,185,624 | 1/1940 | Beck . | |
| 2,649,193 | 8/1953 | Condon | 206/39 |
| 3,302,794 | 2/1967 | Zalkind | 206/39 |
| 3,421,658 | 1/1969 | Coolsey | 206/39 X |
| 4,170,914 | 10/1979 | Carrier | 206/38 X |
| 4,717,908 | 1/1988 | Phillips et al. | 150/147 X |
| 5,020,255 | 6/1991 | Rodel | 206/39.5 X |
| 5,060,794 | 10/1991 | Linn et al. | 206/39.4 X |
| 5,452,793 | 9/1995 | Dimero, Jr. et al. | 206/39 |
| 5,718,329 | 2/1998 | Ippolito et al. | 206/38 |

FOREIGN PATENT DOCUMENTS

| | | | |
|---|---|---|---|
| 0 287 532 | 10/1988 | European Pat. Off. . | |
| 2179341 | 11/1973 | France . | |
| 2580911 | 10/1986 | France | 206/39 |
| 2654081 | 5/1991 | France | 206/39.5 |
| 2 712 265 | 5/1995 | France . | |
| 114898 | 4/1916 | United Kingdom | 150/134 |
| WO 92/18031 | 10/1992 | WIPO . | |

*Primary Examiner*—Sue A. Weaver
*Attorney, Agent, or Firm*—Young & Thompson

[57] ABSTRACT

Box-shaped holder for credit cards or similar products, provided with a front wall (10), two side walls (12, 14) perpendicular to the front wall, a bottom wall (16) which is perpendicular to the side walls but makes an angle of less than 90° with the front wall (10) and an essentially rectangular rear wall (18). The rear wall is able to hinge about a hinge (20) wich runs paralell to the bottom wall in such a way that the top edge of the rear wall moves away from the top edge of the front wall, and vice versa. Furthermore, one section (22) of the rear wall (18) is able to hinge about a hinge (24) located in the rear wall, which hinge runs parallel to the bottom wall in such a way that the edge of the section which faces the bottom wall moves towards the front wall, and vice versa. Furthermore, the holder comprises a spring (26) which pretensions the section (27) of the rear wall in the direction of the hinge movement described above.

25 Claims, 5 Drawing Sheets

HOLDER FOR CREDIT CARDS

FIELD OF THE INVENTION

The invention relates to a holder for credit cards and/or other cards or products which have essentially the same external dimensions with respect to one another.

BACKGROUND OF THE INVENTION

Holders for credit cards or other similar products are known per se in diverse forms from the prior art. A number of these known variants are shown in FIGS. 1A . . . 1G.

FIG. 1A shows a slip case having a front wall, a rear wall, two side walls and a base, which slip case has been manufactured from a relatively hard and inflexible material. Only a few (usually one or two) credit cards fit in this slip case. If more credit cards have to be stored, several slip cases then have to be used and the total storage volume rapidly increases.

FIG. 1B shows a sleeve made of a relatively flexible material. The sleeve consists of an elongated web of material with a pocket in the vicinity of the opposing ends, it being possible to insert a credit card into each of said pockets. The sleeve is folded up about a centre line to protect the cards. In this case also the drawback is that only a relatively small number of cards can be stored in this way, whilst, moreover, because of the use of the relatively limp material of the sleeve, little protection is provided against the cards bending (too far).

FIG. 1C shows a holder in book form with each "page" of the book consisting of a pocket, frequently made of transparent material, it being possible to insert one credit card into each pocket from the side. Because a separate pocket is provided for each card, the total thickness of this container will be relatively large. Putting away or removing a card can sometimes prove somewhat awkward, certainly in warm weather. Moreover, it is fairly laborious to remove grains of sand or other harmful dirt which can collect in the pockets in the course of time and there can lead to damage to the cards.

FIG. 1D shows a solution in which the individual slip-in pockets have been combined into a long strip which can be folded up in zigzag fashion. The disadvantages of this solution are the same as the those described with reference to FIG. 1C.

FIG. 1F shows a holder in book form in which the outside is made of hard plastic material. The cards are inserted in a harmonica configuration which unfolds when the outside walls are unfolded. The hard outside walls in themselves offer good protection against bending of the cards. A disadvantage of this holder is that the harmonica configuration takes up a relatively large amount of space and, moreover, the cost of the holder is substantially increased.

FIG. 1G shows a holder in which the slip-in pockets are located mutually offset in a row one above the other. A solution of this type is widely used in wallets and the like. In general, holders of this type are relatively voluminous, certainly compared with the relatively restricted dimensions of the stack of credit cards which have to be stored in the holder. In general, wallets are made of plastic materials which contain plasticizers. However, these plasticizers, which gradually diffuse from the plastic material to the outside, can attack the material of the credit cards. The cards become brittle as a result and any information which is present on the card can easily be lost.

SUMMARY OF THE INVENTION

The aim of the invention is, now, to provide a holder for credit cards or other flat products which are essentially of the same shape with respect to one another, which holder has small dimensions, is able to hold a relatively large number of credit cards but is also suitable for just one credit card and is made of a relatively hard material and with which it is possible rapidly and easily to select a single credit card from the credit cards present. In particular, the aim of the invention is to provide a holder which combines optimum ease of use with relatively low production costs, so that the holder is, from the commercial standpoint, suitable for a market segment in which the numbers to be produced are relatively large.

These objectives are met by means of a holder for credit cards or similar products, comprising a box-shaped construction consisting of

- an essentially rectangular front wall
- two side walls perpendicular to the front wall
- a bottom wall which is perpendicular to the said side walls but makes an angle $\alpha$ of less than 90° with the front wall
- an essentially rectangular rear wall which can hinge about a hinge which runs parallel to the bottom wall in such a way that, starting from a position in which the rear wall is parallel to the front wall, the top edge of the rear wall moves away from the top edge of the front wall, and vice versa, wherein
  - part of the rear wall is able to hinge about a hinge located in the rear wall, which hinge runs parallel to the bottom wall in such a way that, starting from a position in which the part is located in the plane of the rear wall, the edge of the part which is facing the bottom wall moves towards the front wall, and vice versa,
- a spring with which the said hingeable part of the rear wall is pretensioned in the direction of the hinge movement described above.

Preferably, the angle a has a value between 10° and 80°, and most preferably a value of at least approximately 30°.

As a result of the sloping bottom wall, the cards are stored somewhat offset with respect to one another in the holder. The spring, which presses against the hingeable part of the rear wall, ensures that said hingeable part of the rear wall presses against the stack of cards, as a result of which said stack is permanently under pretension and clamped in the holder. This prevents, inter alia, the cards from rattling in the holder if the holder is only partially filled. Because the rear wall as a whole is able to hinge with respect to the front wall of the holder, cards can easily be pulled slightly outwards together with the rear wall, it being possible, by virtue of the pretensioning, rapidly and easily to leaf through the cards and thus to select the desired card.

In order to prevent one or more cards on the top from being able to fall out, despite the spring tension by which the cards are retained, it is preferable that the holder is provided with a top wall which runs parallel to the bottom wall and extends between the top edges of front wall and rear wall and over only part of the gap between the two side walls.

So as to retain the possibility of easily leafing through the cards despite the presence of a top wall, it is preferable that the top wall takes up only part of the available space between the top edges of front wall, rear wall and side walls, the residual opening preferably being sufficiently large for the user's thumb easily to fit in this gap. In particular, it is preferable that the residual opening is adjacent to one of the side walls, by which means the ease of use of the holder is promoted.

It is preferable that the cards present in the holder have as little as possible mutual movement over one another, so as to prevent wearing of the cards. Holding the cards still is promoted by the fact that the inside of the top wall is provided with an uneven surface. Preferably, the holder is constructed in such a way that the inside of the top wall is provided with a ribbed surface, preferably with ribs parallel to the edges of the front and rear walls. The effect obtained by these means is that the cards are not able to move up and down in the longitudinal direction when they are clamped in the holder. The surface ribs on the top wall prevent this.

The hinge about which the rear wall is able to hinge can be arranged in diverse locations. For example, it is possible to manufacture the bottom wall and the rear wall in one piece and to fit a hinge on the transition between the bottom wall and the front wall. It is also possible to allow only part of the bottom wall to hinge with the rear wall and therefore to fit the hinge somewhere in the bottom wall. However, it is preferable that the hinge about which the rear wall is able to hinge is located on the transition between the front wall and the bottom wall.

The part of the rear wall which is able to hinge with respect to the remaining part can be situated in an arbitrary position in the rear wall. For example, a positioning such that said part abuts one of the side edges or the bottom edge is conceivable. However, in connection with the robustness and stability, it is preferable that, in the position in which the part is located in the plane of the rear wall, the said-part of the rear wall is surrounded on all sides by the remainder of the rear wall.

Nevertheless, in some cases it is preferable that, in the position in which the part is located in the plane of the rear wall, the part of the rear wall adjoins one of the side walls.

BRIEF DESCRIPTION OF THE DRAWINGS

The invention is explained in more detail below with reference to the appended figures.

DETAILED DESCRIPTION OF THE INVENTION

Figure 1A:
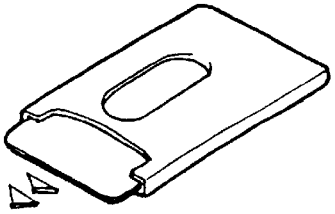
fig-1a PRIOR ART
FIGS. 1A . . . 1G show various embodiments of a credit card holder which are already known from the prior art.
Figure 1B:
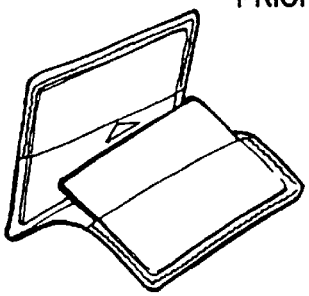
fig-1b PRIOR ART
Figure 1C:
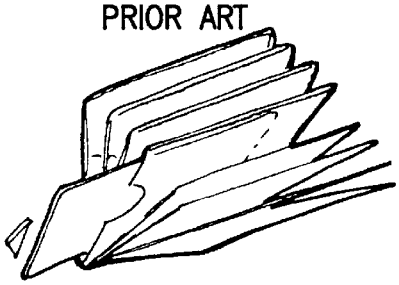
fig-1c PRIOR ART
Figure 1D:
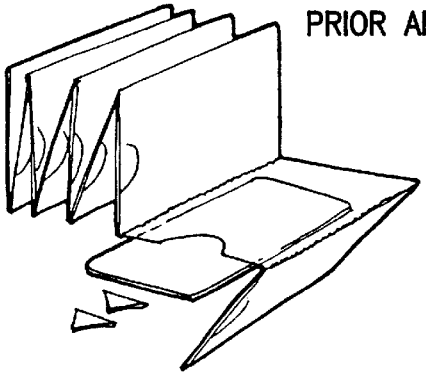
fig-1d PRIOR ART
Figure 1F:
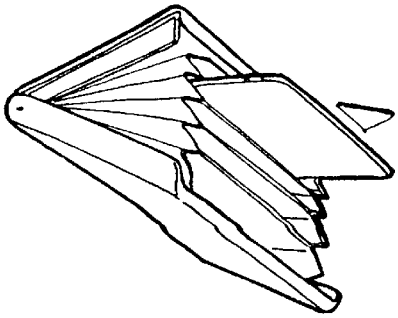
fig-1f PRIOR ART
Figure 1G:
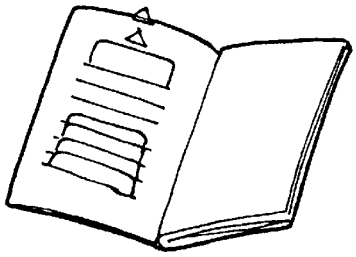
fig-1g PRIOR ART
Figure 2A:
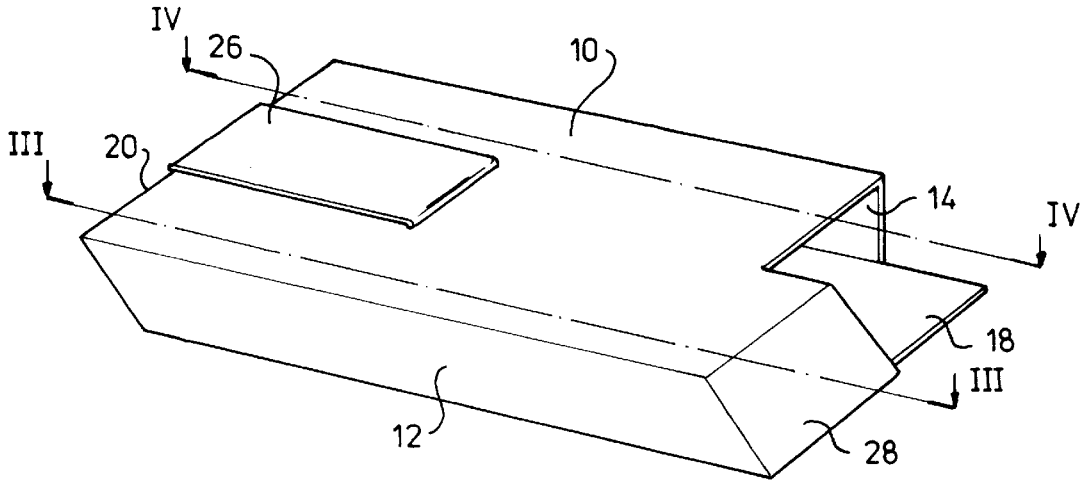
FIGS. 2A and 2B show two views of a holder according to the invention.
Figure 2B:
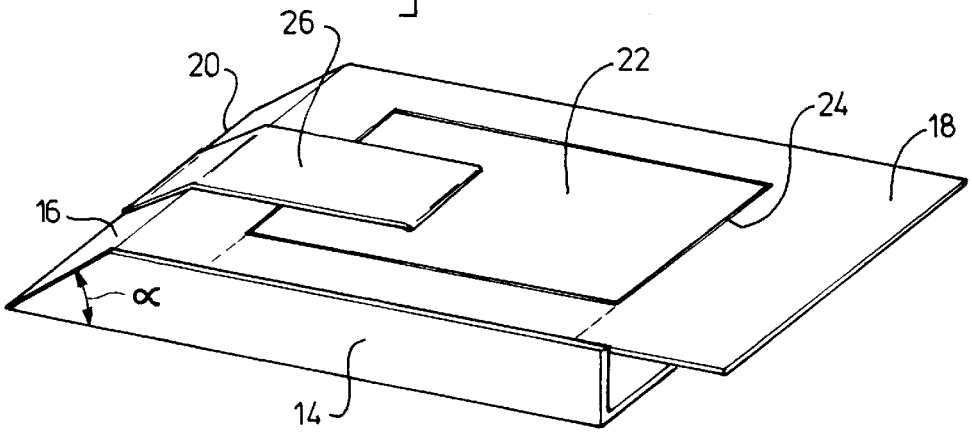

FIG. 2A shows a view of a holder according to the invention in which essentially the front wall, one of the side walls and the top wall are visible, whilst FIG. 2B shows the holder rotated through 180°, essentially the rear wall, the bottom wall and the other side wall being visible. The same reference numerals are used in both figures and these numerals also recur in FIGS. 3 and 4.

In the figures the front wall is indicated by 10, the side walls are indicated by 12 and 14, the bottom wall is indicated by 16 and the rear wall is indicated by 18. In the embodiment shown it is assumed that the front wall 10 and the side walls 12 and 14 are joined to one another as a single whole. Furthermore, the bottom wall 16 and the rear wall 18 are joined to one another as a whole. The connection between the front wall 10 and the bottom wall 16 is formed by a hinge 20 which is located on the angled transition between the bottom wall 16 and the front wall 10. As can also be seen in FIG. 2B, the rear wall 18 is provided with a section 22 which is attached via a hinge 24 to the remaining part of the rear wall 18. The hinged section 22 is pressed inwards by a spring 26. The spring 26 is essentially U-shaped although the connecting arm makes an angle with the two main arms of the U-shape. The spring 26 clamps around the front wall 10, the rear wall 18 and the bottom wall 16 and therefore ensures that the hingeable section 22 is under pretension. In another embodiment, the hinged section 22, in the position in which the hinged section is in the plane of the rear wall 18, joins one of the side walls, as shown in FIG. 2 by the dotted lines.

The holder is preferably also provided with a top wall 28, which at least is firmly joined to the front wall 10 and which extends over part of the space available for the top wall. The portion which is not taken up by the top wall offers a possibility for, as will be explained in more detail below, "leafing" through the stack of cards which can be stored in the holder.

Figure 3:
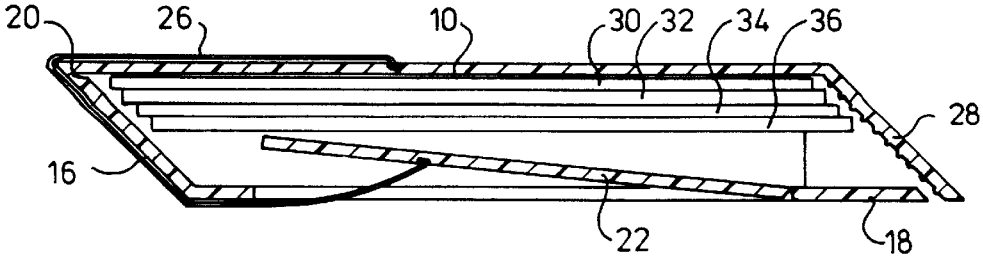
FIG. 3 shows a cross-section along the line III-III in FIG. 2A.

FIG. 3 shows a cross-section along the line III—III in FIG. 2A. It can be seen from FIG. 3 how four cards 30, 32, 34, 36 are stored in the holder and are held in place by the movable section 22 of the rear wall 18, which section 22 presses under pretension by the spring 26 against the bottom card 36 of the stack and thus presses the entire stack against the front wall 10. It can also be seen from the figure that the length of the cards 30, 32, 34 and 36 essentially corresponds to the free space which is available between the bottom wall 16 and the top wall 28. Seen in FIG. 3, the position where the hinged section 22 of the bottom wall 18 presses against the stack of cards is fairly far towards the left. The right-hand ends of the cards consequently have a certain freedom of movement and, in particular, the right-hand end of the bottom card 36 would be able to start to slide down along the top wall 28. In order to prevent this sliding movement, the inside of the top wall 28 is provided with a rough surface. In particular, ribs are arranged on the inner surface of the top wall 28, which ribs run parallel to the cards. By means of said ribs, a sliding movement of the cards over the inside of the top wall 28 is effectively prevented. This risk does not exist at the bottom wall 16 and the inside of the bottom wall 16 can therefore be made smooth.

Figure 4:
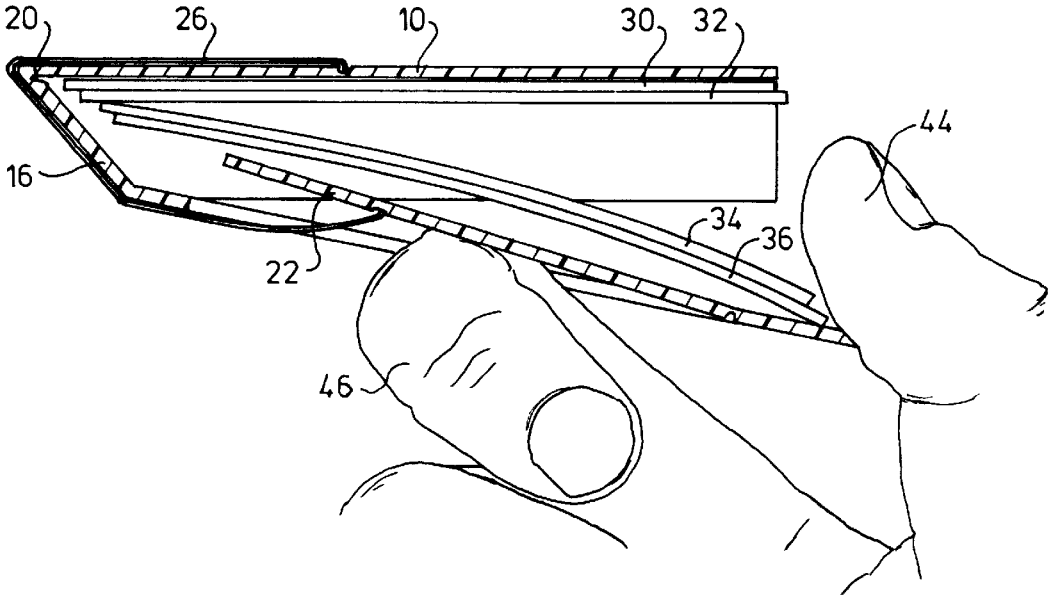
FIG. 4 shows a cross-section along the line IV-IV in FIG. 2A and also indicates diagrammatically how "leafing" through the cards proceeds.
Figure 5:
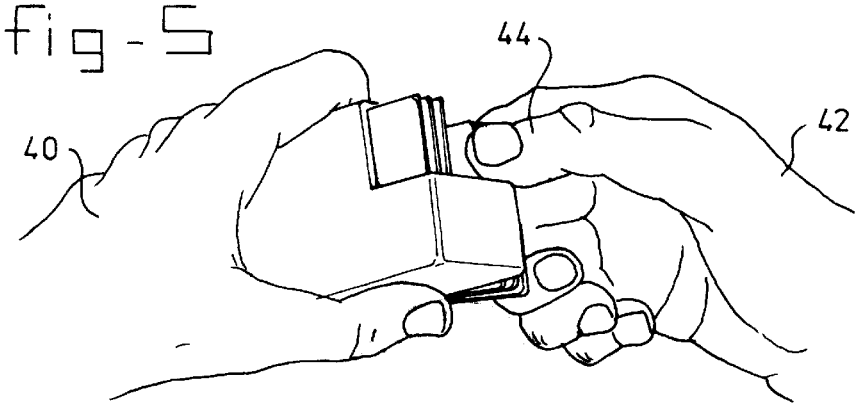
FIGS. 5 and 5A show perspective views of a right-handed and left-handed holder, respectably according to the invention in practice, in particular while leafing through the cards stored in the holder. Every user will, incidentally, quickly develop his or her own "style" of use.

FIG. 4 shows a further cross-section through the holder, in this case along the line IV—IV in FIG. 2A. This figure also indicates diagrammatically the position of the holder during "leafing through" the stock of cards which are stored in the holder. As a supplement to this, FIG. 5 shows a perspective view of an example of how the holder can be held by the user when leafing through. In this context it is pointed out that every user will rapidly develop his or her own "style of use" and that FIG. 5 is therefore given solely by way of example.

Figure 5A:
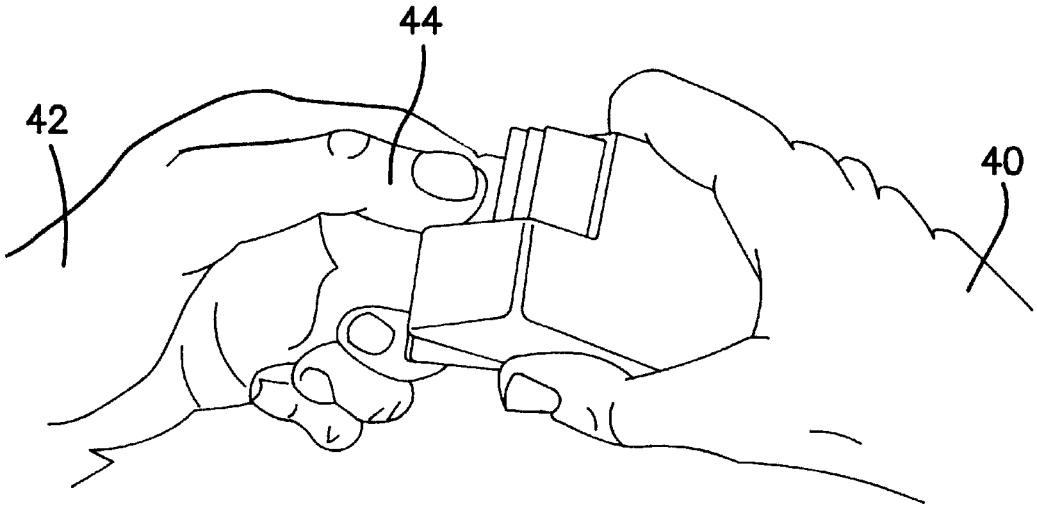

As can be seen from FIG. 5 and 5A, the holder as a whole is held in one hand 40 in such a way that in any event the front wall 10 and the two side walls 12 and 14 are clamped between the thumb and fingers of said hand 40. The rear wall 18 remains essentially free. The leafing movement is carried out using the other hand 42. To this end the thumb 44 is placed on the exposed top edges of the stack of cards in the holder in the manner shown in FIG. 5. The cards, which are lying at a slope on one another, are then pulled a little outward together with the rear wall 18. During this operation, the index finger 46 of the hand can press against the movable section 22 of the rear wall 18 and/or against the spring 26 and so exert an additional pretensioning force on said wall section 22. As a result thereof, the cards are under additional tension, which further facilitates leafing through. If the thumb 44 is now gradually moved in the direction of the rear wall 18, the cards will spring back one by one to the position in which they were before the leafing movement. FIG. 4 shows the situation where cards 30 and 32 have returned to their original position, whilst cards 34 and 36 are still being held by the thumb. At this point, lettering on card 34 can easily be read. Should said card 34 prove to be the desired card, said card can easily be removed from the holder by initially moving the thumb 44 somewhat inwards and holding it firm on the surface of the card 34 and then moving the thumb 44 outwards, the card 34 being taken with it.

It will be clear that any desired card can be selected and removed from the holder in this way. In order to introduce cards into the holder it is necessary merely to pull the rear wall 18 together with the card (or cards) to be inserted in the holder sufficiently far outwards that there is adequate free space between the rear wall 18 and the top wall 28 to insert a card (or cards). If only the rear wall 18 is pulled outwards without pulling the cards, or at least some of the cards, present in the holder with it, the cards present in the holder will then remain pressed against the front wall as a consequence of the pressure which is exerted by the section 22, so that insertion of a new card is therefore not hindered. In order to facilitate insertion even further, it is preferable that the inner surface of the rear wall 18, including the inner surface of the movable section 22, is smooth or is optionally provided with a smooth coating, as a result of which insertion and extraction of cards is facilitated.

However, it is also possible to insert a card in a specific position in the stack. To this end it is necessary to pull not only the rear wall 18 but also the stack of cards present in the holder outward using the thumb and/or the card to be inserted, in a similar way as in the case of the situation where the user wants to leaf through the stack of cards. By now leafing through the stack it is possible to determine the position where the card has to be inserted. As soon as this position is reached, leafing through is stopped and the card is pushed inward into the free space which is now available. Because the cards in the stack are somewhat offset with respect to one another, there is, just as in the case of ordinary leafing through, an interplay of forces between said cards, which ensures that the front cards remain pressed against the front wall 10 under the influence of spring 26 and the hingeable section 22 of the rear wall 18, whilst the cards which have to be behind the card to be inserted are pressed against the rear wall.

Figure 6A:
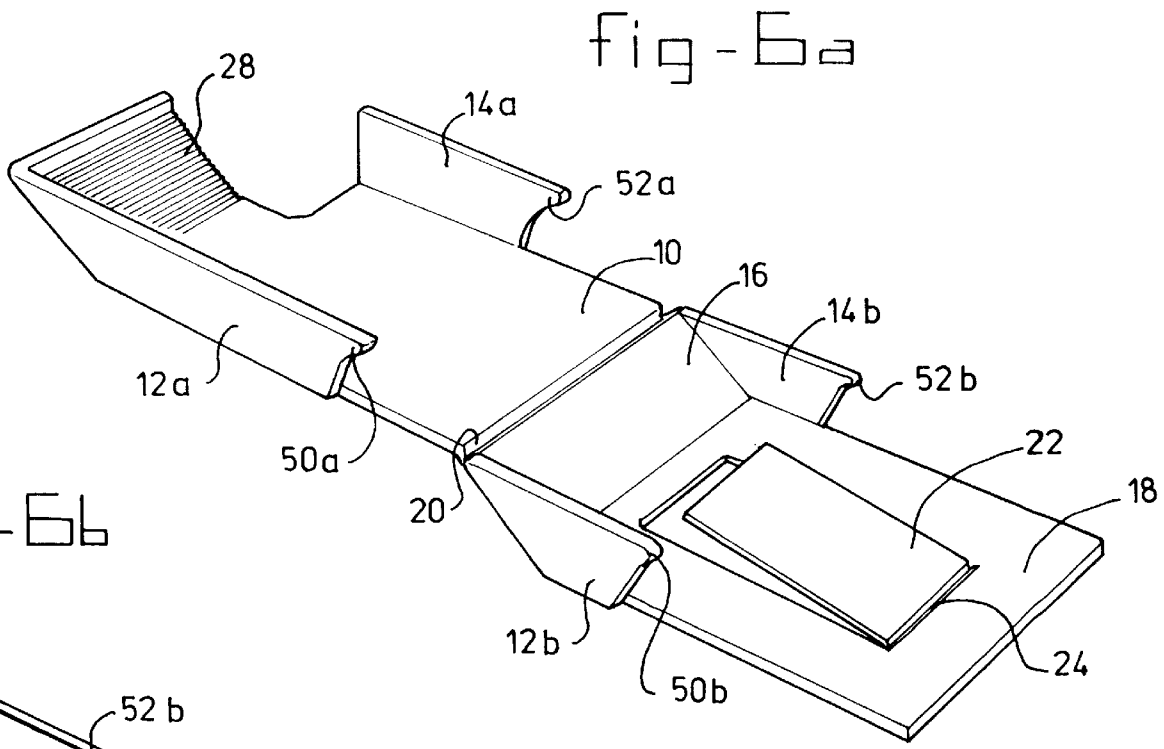
FIGS. 6A and 6B show all parts of the holder, except for the spring, produced as a single injection-molded component.
Figure 6B:
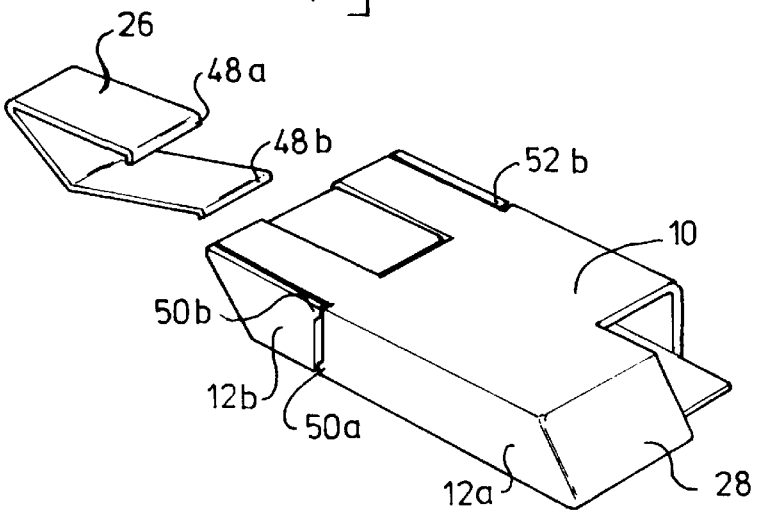

The holder according to the invention is preferably manufactured by an injection moulding process. A preferred embodiment, in which all parts of the holder, with the exception of the spring 26, can be produced as a single injection-moulded component, is shown in FIGS. 6A and 6B. The injection-moulded component which is shown in FIG. 6A comprises, on the left of the figure, the front wall 10, the top wall 28 and parts of the two side walls, indicated by 12*a* and 14*a*, all of which are rigidly joined to one another. On the right, the rear wall 18, the bottom wall 16 and the remaining parts of the two side walls, indicated by 12*b* and 14*b*, are rigidly joined to one another. The hinge, about which the rear wall 18 is able to hinge, is in this case located between the front wall 10 and the bottom wall 16. The hinge is constructed as a film hinge, that is to say as a thin wall section which has sufficient flexibility to be able to serve as a hinge. A hinge construction of this type is also used to attach the movable section 22 hingeably to the remaining section of the rear wall 18. The hinge 24 is thus also constructed as a film hinge.

In FIG. 6B the left hand side of the injection-moulded component has been folded over the right-hand side by means of the hinge 20, the wall sections 12*a* and 12*b* and, respectively, 14a and 14b coming to lie in the extension of one another. In order to complete the assembly, the spring 26 is then slid over the holder in order to be able to perform its function.

The holder depicted in FIGS. 6A and 6B could also have been manufactured from two injection-molded parts, wherein the first injection-molded part comprises at least the front wall 10 and the top wall 28, and the second injection-molded part comprises at least the rear wall 18 and the bottom wall 16. The relevant edges of the bottom wall and the front wall engage with one another to form the first hinge 20, while the hingable part 22 of the rear wall is joined to the remainder of the rear wall via a hinge 24.

As is shown in FIG. 6B, it is preferable to make local cut-outs in the FRONT wall 10, in the bottom wall 16 and in the rear wall 18, the dimensions of said cut-outs essentially corresponding to the dimensions of the arms of the spring 26. The effect achieved by this means is that the spring, in the use position, is essentially located within the volume which is determined by the walls of the holder, so that the spring does not form a protruding part and the holder as a whole has as smooth as possible an outer surface. Furthermore, it is preferable to provide the two free ends of the arms of the spring 26 with fixing means by means of which the spring is held in place in the operational position. In FIGS. 3 and 4 the ends of the arms of the spring are, as an example, provided with curled edges, indicated in FIG. 6B by 48*a* and 48*b*, which engage in corresponding cut-outs in the front wall 10 and, respectively, in the movable wall section 22. By this means the spring is secured in its position and detachment of the spring is prevented. It is also possible to make a hole in each of the arms of the spring, in which holes a protuberance on the front wall 10 and, respectively, rear wall 18 engages, so that the spring is secured. Other fixing means are possible and are assumed to be known per se to a person skilled in the art.

As is also shown in FIGS. 6A and 6B, the wall section 12*a* is provided with a protruding ridge 50*a* and the wall section 12*b* is provided with a protruding ridge 50*b*. In the assembled state, which is shown in FIG. 6B, said ridges 50*a* and 50*b* ensure that the movement of the rear wall 18 about the hinge 20 is limited. The rear wall 18 can be pulled out of the holder until the two ridges impinge on one another. Similar ridges with a similar function are arranged on the wall sections 14*a* and 14*b*, which ridges are designated as 52*a* and 52*b* in FIG. 6A.

In the above the use of film hinges is indicated for the hinges 20 and 24. However, it will be clear to a person skilled in the art that other hinge constructions can also be used without going beyond the scope of the invention. However, the use of a film hinge construction in general leads to a relatively inexpensive manufacturing process.

In the above, reference has been made by way of example to the use of the holder for storing cards, in particular credit cards. However, it will be clear that the holder can also be used for other products, such as smart cards, diskettes, business cards and the like. In principle the holder can be used for flat products of essentially the same dimensions.

It has been indicated above that the construction of the holder can be made relatively inexpensive, in particular if use is made of injection-moulded components. However, the invention is not restricted to this. It will be clear that other techniques, sometimes involving higher production costs, can be used, for example in order to produce "more luxurious" embodiments of the holder.

No information has been given above with regard to the dimensions and the positioning of the hingeable wall section 22 of the rear wall 18. In general there are also no special requirements in this regard. In connection with the use of cards on which a magnetizable strip is arranged, it can, however, be preferable to select the position and dimensions of the movable section 22 in such a way that said section does not come into contact with the magnetizable strips in order to prevent damage to said strips. In connection with cards in which or on which electronic chips are arranged, it can likewise be preferable to select the position and dimensions of the section 22 as advantageously as possible.

What is claimed is:

1. Holder for products having essentially the same dimensions, the holder comprising a box-shaped construction consisting of an essentially rectangular front wall, two side walls perpendicular to the front wall, a bottom wall which is perpendicular to the side walls but makes an angle of less than 90° with the front wall, an essentially rectangular rear wall comprising an opening, a spring which acts through said opening in the rear wall on the products inside the holder, wherein said rear wall can hinge about a first hinge which runs parallel to the bottom wall such that, starting from a position in which the rear wall is parallel to the front wall, a top edge of the rear wall moves away from a top edge of the front wall, and vice versa, a hingeable part of the rear wall located within said opening is able to hinge about a second hinge located in the rear wall, and which runs parallel to the bottom wall such that, starting from a position in which the hingeable part is located in the plane of the rear wall, an edge of the hingeable part facing the bottom wall moves towards the front wall, and vice versa, whereby said spring engages said hingeable part of the rear wall, such that said hingeable part is pretensioned in the direction of hinge movement.

2. Holder according to claim 1, further comprising a top wall which runs parallel to the bottom wall and extends between the top edges of the front wall and the rear wall and over only part of the gap between the two side walls.

3. Holder according to claim 2, wherein the top wall has an uneven inner surface.

4. Holder according to claim 2, wherein the top wall has a ribbed inner surface comprised of ribs parallel to the edges of the front and rear walls.

5. Holder according to claim 2, wherein the top wall consists of one piece which adjoins one of the side walls so that part of the space between the top edges of the front wall and the rear wall adjoining the other side wall remains open.

6. Holder according to claim 5, wherein the choice of which side wall the top wall must adjoin is dependent on whether a user of the holder is left-handed or righthanded.

7. Holder according to claim 5, wherein the front wall is provided with a first cut-out which runs from that part of the top edge which does not adjoin the top wall.

8. Holder according to claim 7, wherein a second cut-out is also made in a side edge which does not adjoin the top edge, said second cut-out adjoining the first cut-out in the top wall.

9. Holder according to claim 2, wherein the holder, with the exception of the spring, is manufactured from a single injection-molded part, the front wall and the top wall-being firmly joined to one another, the rear wall and the bottom wall being firmly joined to one another, the first hinge joining the rear wall to the bottom wall, and the second hinge joining the hingeable part of the rear wall to the remainder of the rear wall, and said first and second hinges comprising film hinges.

10. Holder according to claim 9, wherein each of the side walls is subdivided into two parts, one part of which in each case is firmly joined to at least the front wall and the other part of which is joined to at least the rear wall and adjoining edges of the two parts of each wall being shaped such that deflection of the hinge movement of the rear wall is limited.

11. Holder according to claim 2, wherein the holder, with the exception of the spring, is manufactured from two injection-molded parts, a first injection-molded part comprising at least the front wall and the top wall, which are firmly joined to one another, a second injection-molded part comprising at least the rear wall and the bottom wall, which are firmly joined to one another, the relevant edges of bottom wall and front wall being formed so as to engage with one another with the formation of the first hinge, while the hingeable part of the rear wall is joined via the second hinge to the remainder of the rear wall, and said first and second hinges comprising film hinges.

12. Holder according to claim 11, wherein each of the side walls is subdivided into two parts, one part of which in each case is firmly joined to at least the front wall and the other part of which is joined to at least the rear wall and adjoining edges of the two parts of each wall being shaped such that deflection of the hinge movement of the rear wall is limited.

13. Holder according to claim 1, wherein the first hinge about which the rear wall is able to hinge is located on a transition between the front wall and the bottom wall.

14. Holder according to claim 1, wherein the hingeable part of the rear wall, in the position in which the part is located in the plane of the rear wall, is surrounded on all sides by the remainder of the rear wall.

15. Holder according to claim 1, wherein the hingeable part of the rear wall, in the position in which the hingeable part is located in the plane of the rear wall, adjoins one of the side walls.

16. Holder according to claim 1, wherein the hingeable part of the rear wall, in the position in which the hingeable part is located in the plane of the rear wall, adjoins the bottom wall.

17. Holder according to claim 1, wherein the bottom wall has an inner surface which is provided with a smooth finish or a smooth coating.

18. Holder according to claim 17, wherein the angle is at least approximately equal to 30°.

19. Holder according to claim 1, wherein at least part of the inner surface of the rear wall is provided with a smooth finish or a smooth coating.

20. Holder according to claim 19, wherein the smooth surface extends between the top edge and the bottom edge-of the rear wall.

21. Holder according to claim 1, wherein the top edge of the rear wall is chamfered such that the top edge of the rear wall makes an acute angle with the outer surface of the rear wall.

22. Holder according to claim 1, wherein the angle between the bottom wall and the front wall has a value of between 10° and 80°.

23. Holder according to claim 1, wherein the spring is formed by a flat strip of resilient material which has been bent in an essentially U-shape and is slid over the holder such that one arm of the U-shape rests against the front wall, the other arm of the U-shape rests against the hingeable part of the rear wall, and the connecting arm of the U-shape essentially bears against the bottom wall.

24. Holder according to claim 23, wherein the connecting arm of the U-shape makes an angle with the two other arms of the U-shape such that, in an assembled state of the holder, the connecting arm runs parallel to the bottom wall.

25. Holder according to claim 23, wherein edges of the two arms of the U-shape which face away from the connecting arm are provided with fixing means which interact with corresponding fixing means of the front wall and, respectively, of the hingeable part of the rear wall.

* * * * *